US006094054A

United States Patent [19]

Crist

[11] Patent Number: 6,094,054

[45] **Date of Patent: *Jul. 25, 2000**

[54] RADOME NOSE CONE PROBE APPARATUS FOR USE WITH ELECTROSTATIC SENSOR

[75] Inventor: Scott D. Crist, Minnetonka, Minn.

[73] Assignee: Alliant Techsystems Inc., Hopkins, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/668,690

[22] Filed: Jun. 24, 1996

[51] Int. Cl.[7] ..... F42C 13/00; G01N 27/60

[52] U.S. Cl. ..... 324/452; 102/211

[58] Field of Search ..... 102/211, 216; 324/452

[56] References Cited

U.S. PATENT DOCUMENTS

| | | | |
|---|---|---|---|
| 3,218,623 | 11/1965 | Buntenbach | 102/211 |
| 3,722,415 | 3/1973 | Lunt . | |
| 3,838,645 | 10/1974 | Finger et al. | 102/211 |
| 3,871,296 | 3/1975 | Heilprin et al. | 102/211 |
| 3,882,781 | 5/1975 | Krupen . | |
| 3,889,599 | 6/1975 | Apstein | 102/211 |
| 4,400,421 | 8/1983 | Stover | 428/113 |
| 4,515,847 | 5/1985 | Taverna | 428/107 |
| 4,867,357 | 9/1989 | Inglis et al. | 244/121 |
| 4,894,862 | 1/1990 | Defretin | 379/390 |
| 4,972,775 | 11/1990 | Hoyt | 102/211 |
| 5,457,471 | 10/1995 | Epperson | 343/872 |

FOREIGN PATENT DOCUMENTS

| | | | |
|---|---|---|---|
| 1593485 | 7/1981 | United Kingdom | 102/211 |

OTHER PUBLICATIONS

David M. Hull et al., "Field Firings of Electrostatic Sensors on 120–mm Rounds", Army Research Lab Pub. #ARL–TR–837, pp. 5–7, Jun. 1995.

Weast, Handbook of Chemistry and Physics, CRC Press, 18901 Cranwood Pky, Cleveland, OH 44128, p. E–60, 1976.

Article entitled Eleectrostatic Sensing for Air–Target Fuzing, by U.S. Army Laboratory Command. (No Date Available).

Articled entitled Electromagnetic Radiation of Projectiles and Missles During Free Flight, and Impact Breakdown: Physical Effects and Applications, by H. Trinks, dated Jun. 1993.

Hull, David, Army Research Laboratory Fax, p. 1, May 1, 1997.

*Primary Examiner*—Josie Ballato

*Attorney, Agent, or Firm*—Vidas, Arrett & Steinkraus, P.A.

[57] ABSTRACT

A radome probe apparatus for use with an electrostatic proximity sensor is disclosed. The apparatus comprises a radome nose cone probe connected to a projectile and having an inner surface. The nose cone is made of a dielectric material. Single or multiple electrically conducting areas are connected to the inner surface of the nose cone. The conducting areas are dielectrically isolated. Electronics are utilized to sense the time rate of change voltage or current between the areas due to the intrinsic electrostatic charge on a target aircraft.

21 Claims, 5 Drawing Sheets

2
12
20
22
10
2
27

RADOME NOSE CONE PROBE APPARATUS FOR USE WITH ELECTROSTATIC SENSOR

FIELD OF THE INVENTION

This invention relates to the field of projectiles utilizing proximity fuze sensors and more particularly, to a radome nose cone assembly for use with a passive electrostatic proximity fuze sensor which detects the intrinsic electrical charge on threat aircraft and helicopters using dielectrically isolated electrode surfaces.

BACKGROUND OF THE INVENTION

Previously, RF proximity fuzes have been utilized. However, larger projectile fuzes have typically required multiple piece nose cones where the user chooses a target selector switch setting at the time of launch depending on the desired target i.e., "ground" or "airborne". This requirement of user input before firing is time consuming and can lead to user error. The switch setting is necessary because radio frequency proximity fuzes are prone to false targets in certain "flat fire" scenarios. The false targets (clutter) may stem from trees, buildings, natural landmarks such as rocks and battlefield debris or hulks. False targets will cause detonation before the desired target is reached.

Further, traditionally, a radome is provided for RF proximity fuzes and is generally made of molded plastic material. However, the high tip temperatures of some projectiles in flight require a protective metal tip to dissipate the heat which would otherwise destroy the plastic. This complicates the assembly. Also, probable ablation of the plastic (charged during flight) would be a source of electrostatic noise which is not acceptable in the case of electrostatic proximity fuzing.

In order to avoid these problems and the need for a target selector switch, it is desirable to utilize a fuze sensor which detects the intrinsic electrical charge of an air-borne target. The electrostatic proximity fuze sensor minimizes false targets and is less vulnerable to countermeasures and clutter.

Electrostatic advanced development proximity sensors have been previously developed. The U.S. Army developed a proximity sensor in 1977 for use against helicopters. Also, General Electric was under contract with the U.S. Army to develop a helicopter proximity demonstration test sensor in the late 1980's. However, these sensors included relatively complex external probe configurations. The sensors were external dielectrically isolated annular nose cone electrodes, some with feed-through connections and EMI filters. External probe configurations lead to electrical interconnect problems. Because the sensor electrodes are external to the nose cone, the feed-through connections are required.

An electrostatic sensor nose probe/tip for "smart" munitions must withstand relatively high mechanical and thermal stresses during launch and flight. It also must be relatively nonconductive and nonablative. For some projectiles, setback forces during launch are 50,000 g's as the round accelerates to velocities approaching Mach 4 (1400 m/s). The boundary layer temperature near the tip of the nose cone reaches 1100° C. within a few tenths of a second after launch. Ceramic materials are ideally suited for withstanding the stresses during flight and provide the required probe functionality.

Consequently, the need remains for an electrostatic proximity fuze for use in projectiles where the sensor is internal to the nose cone and which is able to withstand the conditions noted above. The present invention eliminates any electronic or environmental constraints allowing for a durable, reliable sensor which results in significant performance improvement for the projectile.

The art referred to and/or described above is not intended to constitute an admission that any patent, publication or other information referred to herein as "prior art" with respect to this invention. In addition, this section should not be construed to mean that a search has been made or that no other pertinent information as defined in 37 C.F.R. §1.56(a) exists.

SUMMARY OF THE INVENTION

Smart munitions, projectiles, missiles and ammunition utilize sensors which must have an electromagnetically unobstructed view of the target/scenario and a protective environment. A ceramic nose cone connected to the projectile body provides an electromagnetically unobstructed view and a protective environment. Specific sensor metallization electrode surfaces/patterns can be deposited on the inside surface of the nose cone to form a simple, ruggedized, hermetic one-piece (monolithic) nose probe assembly. In addition, surface mount electronic components may be integrated with the sensor electrode metallization patterns. Therefore, these munitions provide a hermetic window for electrostatic or capacitive sensors. The invention provides a nose cone probe apparatus and sensor which is less complex, more rugged, and potentially lower cost than other probe configurations currently in use.

As stated above, one advantage of the invention is its simplified one piece configuration. Also, the internal metallized sensor electrode or electrodes are directly connected to electronics within the nose cone, in the base, or in the body of the projectile, munition or missile. This connection eliminates an electrode feed-through electrical connection. The ceramic radome construction is not subject to ablation and its composition can provide EMI shielding if a ferrite filled ceramic is utilized. In addition, the ceramic conductivity may be controlled to provide static charge dissipation during flight. The invention provides a hermetically sealed assembly for greater reliability.

The invention is a sensing apparatus for sensing the inherent electric field surrounding an electrostatically charged threat aircraft for use with a projectile, munition or missile which includes a nose cone of a dielectric material, the nose cone having an inner surface; an electrically conductive area or areas connected to the inner surface of the nose cone and conductively separated from the projectile body; and detection means for detecting the time changing electric field surrounding an electrostatically charged threat aircraft where the detection means is connected to the conductive area or areas and the projectile body. A second reference conductive body may also be located within the nose cone, separated from the first conductive body and connected to the projectile body or detection means. Multiple conductive electrode areas may be employed.

The conductive areas act as plates of a capacitor and the time changing electrostatic field of a target aircraft causes free electrons to move between the plates of the capacitor. Electronics are used to measure the current or voltage between the plates and processing is used to determine when the projectile should be detonated. Circuit design controls the wide signal dynamic range and frequency response for a given mission or target detection scenario. The processor communicates with a fuze for detonation. A nose crush switch is also used with the invention for direct contact detonation.

These and other advantages and features which characterize the invention are pointed out with particularity in the claims annexed hereto and forming a further part hereof. However, for a better understanding of the invention, its advantages and objects obtained by its use, reference should be made to the drawings which form a further part hereof, and the accompanying descriptive matter, in which there is illustrated and described a preferred embodiment of the invention.

BRIEF DESCRIPTION OF THE DRAWINGS

In the drawings, wherein like reference numerals represent like parts throughout the several views.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated.

Figure 1:
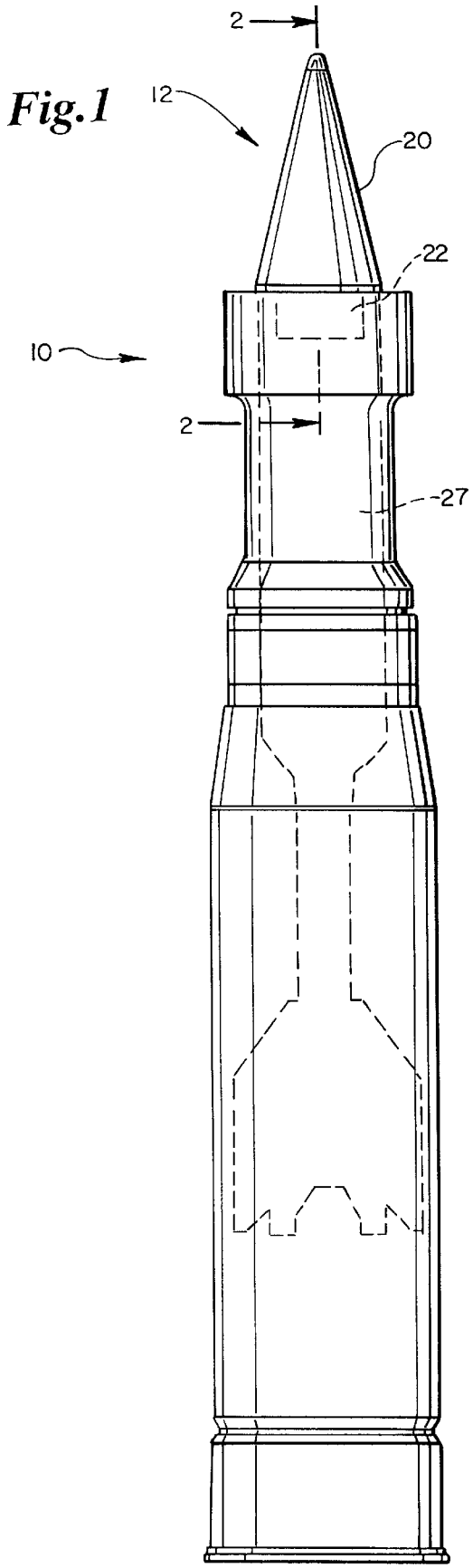
FIG. 1 illustrates a side elevational view of a projectile including the invention.
Figure 2:
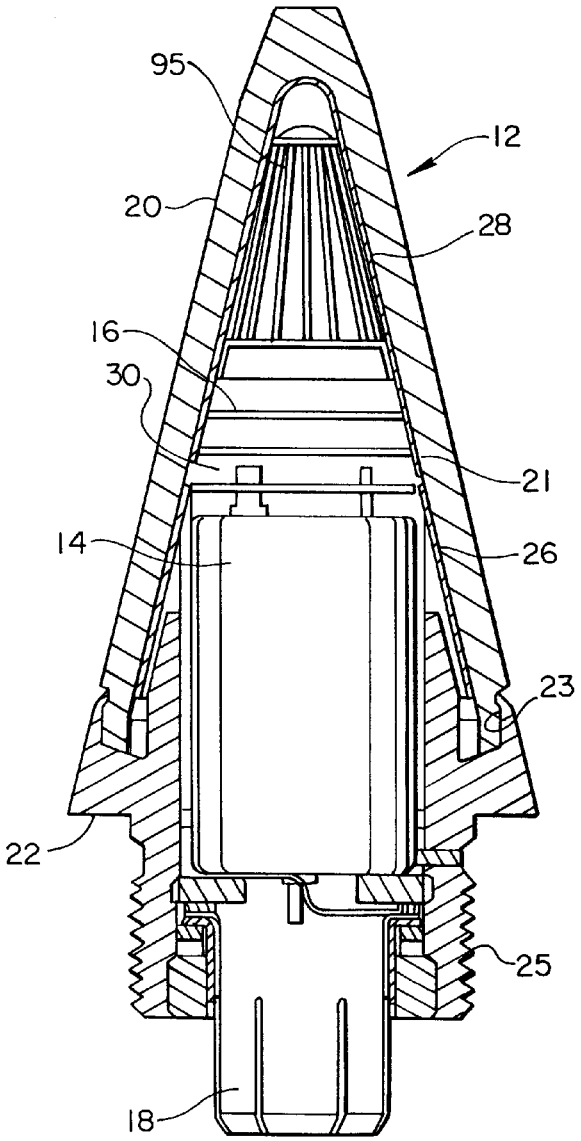
FIG. 2 illustrates a cross sectional view of the radome nose cone probe assembly taken along the lines 2—2 of FIG. 1.

Referring to FIG. 1, there is shown a projectile 10. For the purposes of this application, the term projectile will be used when describing the invention. It should be understood that the term projectile includes projectiles, missiles, and munitions for this description and the claims. The projectile 10 includes a nose cone assembly or probe assembly 12. The probe assembly 12 is as shown in detail in FIGS. 2, 3, and 4. The projectile 10 also includes a power source 14 and electronics 16 as seen in FIG. 2. An interface connector 18 is also included. In the preferred embodiment, the power source 14, electronics 16 and connector 18 are located within the assembly 12. It should be understood that the power source 14 and electronics 16 may be located within the body of the projectile 10 and not in the assembly 12.

While not specifically detailed in the Figures, it will be understood that the various electronics and electronic functional blocks included herein are properly connected to appropriate bias and reference supplies so as to operate in their intended manner. It should also be understood that the processing described herein utilizes well known technology which is connected to appropriate memory, buffer and other peripheral devices so as to operate in their intended manner.

The assembly 12 includes a nose cone 20 and a base 22 and one or more electrode surfaces to be described later. The nose cone or radome 20 is generally conical in shape in the preferred embodiment. The projectile shown in FIG. 1 is a 120 mm tank ammunition round. Therefore, the nose cone 20 in FIGS. 1–4 is the appropriate aerodynamic shape for this munition. It should be understood that any appropriate shape may be utilized with the invention depending on the application and the projectile, munition or missile. The nose cone or radome 20 is made of a dielectric material and has an inner surface 21. A dielectric material which withstands the conditions under which the projectile operates is ceramic. In the preferred embodiment the radome 20 is made of ferrite ceramic. The RF absorption properties of the ferrite radome 20 provide external RFI shielding of the sensor electrode or electrodes and the electronics which will be discussed in further detail later in this description. Also, the ceramic electrical conductivity can be controlled such as to prevent build-up of excessive static charge during flight. Although ferrite ceramic is used in the preferred embodiment, it should be understood that many different dielectric materials may be used. If conditions are such that the projectile moves at relatively low velocities the cone 20 could be made of a plastic, in combination with a metal tip if necessary. Generally, a ceramic will be used. For example, silicon nitride may be utilized. As one skilled in the art knows, the choice of ceramic is dependant on the specifications of the projectile and its intended use. Silicon carbide, a semiconducting material, may be used for high velocity applications. This material aids in dissipating charge built up from the air. This minimizes the noise pulses that are generated by micro arcs, corona, or charge on the nose.

The base 22 is generally cylindrical in shape with modifications so the base 22 fits within or is received by the projectile 10. In the preferred embodiment, the base 22 is constructed of metal such as stainless steel or KOVAR® which are well known composite materials. KOVAR is made of nickel, cobalt, magnesium and iron and manufactured by Stupakoff Ceramic and Mfg. Co. The base 22 is connected to the projectile 10 by means well known to those skilled in the art such as threads 25 or other suitable means. The base 22 may also be a ceramic. Any suitable materials may be used for the base 22.

The nose cone 20 is eutectically bonded to the base 22 in the preferred embodiment. A roll-crimped base-cone interface or collar may also be used to provide additional mechanical constraint of the nose cone as shown in FIG. 2. Lead-silver or high temperature gold-indium solder may be used for example. This ceramic to metal joint 23 is affected by several factors including geometry, thermal expansion coefficient mismatch, bonding temperature and point loading of the ceramic to metal surfaces. The ideal joint is formed when the ceramic is in compression. To place the ceramic in compression during joining, the higher expansion housing 22 alloy must shrink around the ceramic nose cone 20. One approach to achieving this geometry is to bevel the ceramic cone 20 and the housing or base 22 so that the nose cone 20 sits inside the housing 22 at the joint. Those skilled in the art will understand that this is just an example and that other methods of achieving a satisfactory bond may be employed. Appropriate selection of materials can minimize the problems encountered when such a joint is formed. Other methods for bonding include brazing, crimping and the use of epoxy, as well as other known methods.

The eutectically bonded ceramic nose 20 and base 22 provide a hermetic seal for the interior electrode or electrodes of the sensor. The sealed assembly 12 provides a shield for sensor functions from the high temperatures and also provides a support structure for the sensor surfaces which will be described in more detail below.

Figure 3:
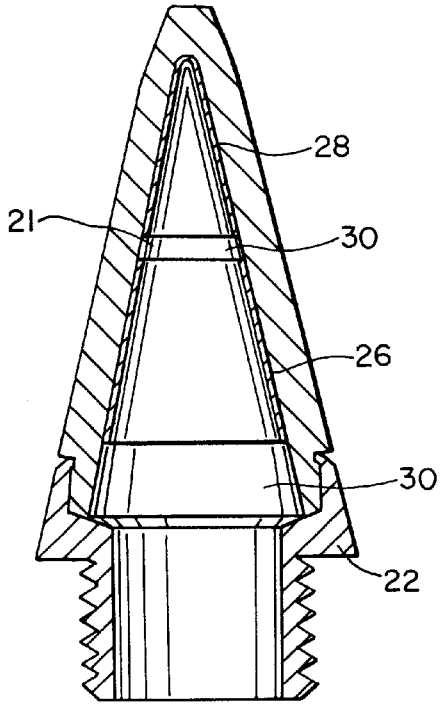
FIG. 3 illustrates a cross sectional view of the nose cone of the invention with metallization taken along the lines 2—2 of FIG. 1.
Figure 4:
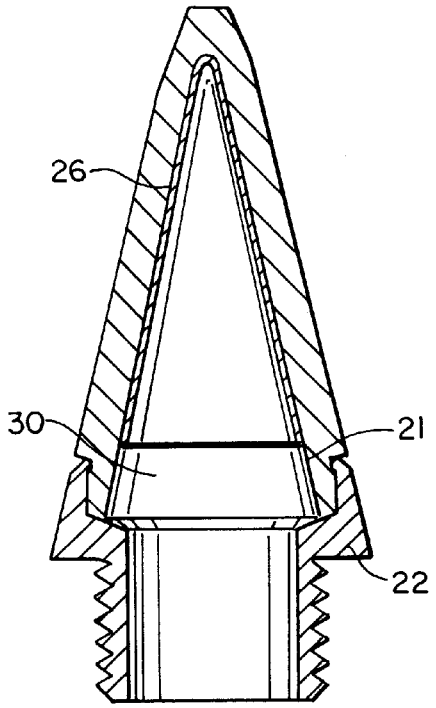
FIG. 4 illustrates a cross sectional view of the nose cone of the invention with another embodiment of metallization taken along the lines 2—2 of FIG. 1.

A single isolated electrically conductive area or electrode 26 of the probe assembly 12 is shown in FIG. 4. The conductive area 26 is connected to the inner surface 21 of the nose 20. This electrode 26 is an area of metallization in the preferred embodiment and is one plate of a capacitor. The conductive material may be sputtered on, electroplated or a conductive epoxy may be used among other methods of application. A second conductive area, described below, is necessary for the invention to function. The second conductive area can be an area of metallization 28 or the projectile body 27 or both. Another embodiment of the invention may include an electrode sleeve which is held between the inner surface of the nose cone 20 and the electronics 16. In this embodiment, the conductive area would not be bonded directly to the ceramic, but would be placed as shown in FIGS. 2–4. The sleeve would be a metal in a frusto conical shape, for example. Any appropriate shape may be utilized.

In the preferred embodiment, the body 27 of the projectile 10 is used as a second conductive area. The body 27 is electrically tied to the nose probe assembly 12 and forms the second plate of a capacitive dipole sensor. The electrical connection of the projectile body 27 (second conductive area) to the nose probe assembly 12 is by any appropriate means known to those skilled in the art. FIG. 4 shows gap 30 between the first conductive area 26 and the conductive body 27/base 22 of the projectile in this embodiment. The gap 30 is an area of nonconductive material, in this case, the ceramic of the nose cone. Therefore, two discreet electrode sections are formed. It should be understood that other nonconductive materials may be used.

FIG. 3 shows an alternative embodiment of the invention. A second area of metallization 28 (second conductive area) is utilized in the nose 20 of the projectile 10 in this embodiment. The conductive areas 26 and 28 are both within the nose cone 20 of the invention and both areas are connected to the inner surface 21 of the nose 20. The metallization of the areas 26 and 28 may be of any appropriate thickness or dimensions. FIGS. 2 and 3 further show a gap 30 in metallization. This dielectric gap 30 separates the conductive area 26 from the metal base 22 and second conductive area 28. The gap 30 is an area of nonconductive material or area of insulation. The gap 30 is the ceramic material of that portion of the nose cone 20 in the preferred embodiment. In this manner, isolated electrode sections are formed. The area of nonconductive material 30 may be of any appropriate type that may be added to the nose cone 20.

Yet another embodiment utilizes two areas of metallization within the nose cone 20 and connects one of these areas to the projectile body 27. In this embodiment the conductive areas 26 and 28 are utilized as described above and the body 27 of the projectile is also used. The body 27 is conductively connected to the forward area of metalization 28 so that they are at the same electrical potential. Therefore, the processing of the invention is done between the first conductive area 26 as one plate of the capacitor and the second conductive area 28/body 27 at the same potential as the other plate of the capacitor.

Yet another embodiment would utilize multiple active areas of metallization functioning with respect to the projectile body. This embodiment provides additional processing discrimination and/or target location information. In this embodiment, the conductive area 26 would be utilized as one plate of a capacitor and the body 27 of the projectile would be used as the second plate of a capacitor. Further, the conductive area 28 would be utilized as one plate of a second capacitor and the body 27 of the projectile would be used as the second plate of the second capacitor. The processing to be described in further detail below would then be utilized with the two capacitors to provide additional information and/or processing discrimination. Additional areas of metallization could be added so that a combination of the described embodiments could be achieved. For example, a third conductive area could be included and used with the body 27 tied to the electrode area 28 to form one capacitor and the conductive area 26 and the body 27 could form another capacitor.

In the embodiments described above where the body 27 of the projectile 10 is used as one plate of a capacitor, the body 27 would be made of a conductive material. Of course, if the body 27 of the projectile 10 is nonconductive then the nose probe 20 would include two discreet areas of metallization. It should be understood that the size and shape of conductive areas vary as desired and appropriate. The conductive areas may be segmented or may be a solid ring, for example. The segmented area is utilized so that the segments can spatially/radially process threat aircraft utilizing multiple channel detection means. The segments utilized may be axial or longitudinal as may be desired. Single or multiple surfaces allow for either differential or spatial radial signal processing options using front-end electronics.

Figure 5:
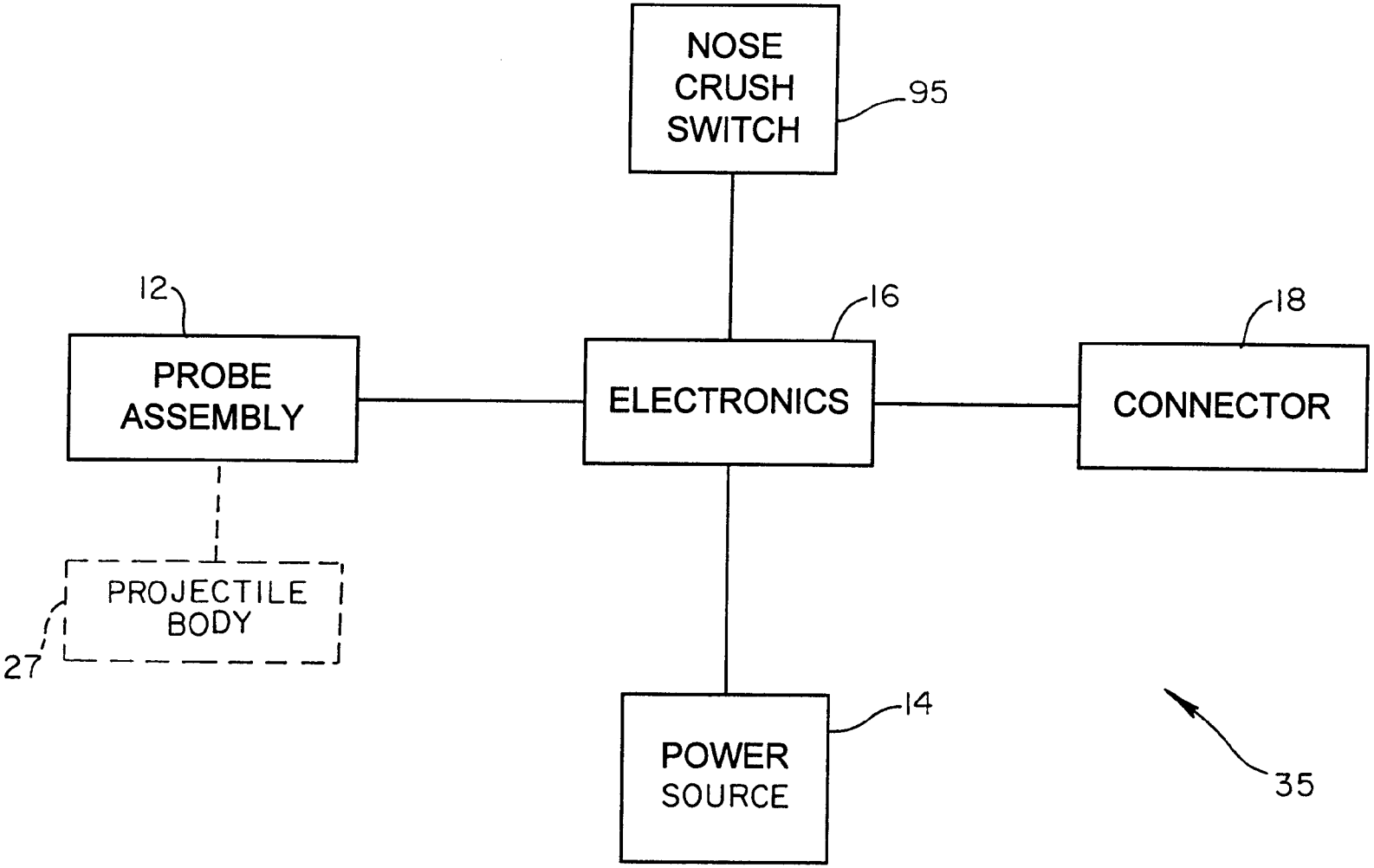
FIG. 5 illustrates a block diagram of a fuze sensor utilizing the invention.

For the invention to function as a sensor, the plates of the capacitor formed by the conductive areas and/or body described above must be connected to the projectile 10 in a manner so that the external time changing electric field between the two plates may be detected and communicated to the projectile 10. A block diagram of the sensor 35 is shown in FIG. 5 and includes the probe assembly 12, power source 14, electronics 16, connector 18, crush switch 95 and projectile body 27 (as may be desired in an embodiment). The interface connector 18 is connected to the base 22 of the assembly 12 and includes appropriate connectors and electronics for connection, operation, and communication of the sensor 35 with the projectile 10. An external time changing electric field may be detected between the plates of the capacitor formed as described above. The interface connector 18 is connected to the electronics 16 and battery source 14 for operation. The battery 14 may be a single cell 3 volt lithium reserve battery. The power source 14 may also be of a type where setback of the projectile 10 powers a capacitor to provide power for the sensor 35. This type of power source is well known to those skilled in the art. The connector 18 may be of any appropriate type known to those skilled in the art.

The electrode surfaces are a function of the sensor type. Any number of surfaces or patterns may be utilized with the nose cone assembly 12 to provide a different number of sensor functions. The electrostatic sensor 35 described herein is an example of a sensor. In the preferred embodiment, the electrostatic sensor electrode pattern is formed on the inside of the nose cone 20 which is dielectrically isolated from the fuze metal base 22 and projectile body 27. Direct attachment of lead wires from sensor electronics 16 to the electrode surfaces 26 and 28 is made in one embodiment. Direct attachment of the body 27 and the electrode surface 26 to the electronics is made in another embodiment. The conductive connection of the plates of the capacitor for the various embodiments is made as necessary. The sensor electronics 16 may be directly attached to the inner surface 21 of the cone 20 if operating conditions permit. In the preferred embodiment, the electronics 16 are located in a generally right frustrum shaped module with contacts on the outside where contact is made with the conductive area(s) when the module is placed in the cone 20. In the preferred embodiment, the electronics 16 includes circuit boards which contain the analog and digital electronics to regulate the power from the battery, detect air targets and electrically switch the connector upon air target proximity or hard target impact. The electronics 16 interfaces with the rest of the projectile fuzing system through a circuit which attaches to the connector 18. The electronics 16 may also be located in one or more other areas. The electronics 16 may also be placed in the cone 20 for some applications but may be in the projectile 10 or missile for others. When more than one capacitor is utilized each capacitor may be tied differentially to separate electronics 16. More than one capacitor would be used for differential or spatial target signal processing. The specific electronics utilized may be of any appropriate type for this application and are generally known to those skilled in the art.

All aircraft are electrically charged during flight. An electrostatic probe 12 moving past a target can detect the electric field surrounding this charge and therefore can be used as a proximity sensor. Each type of aircraft has a characteristic electric field or signature which can be determined and therefore a target can be "identified" with the proximity sensor 35 and ultimately the projectile will be detonated at the appropriate time. The dipole sensor senses or detects the time changing electric field between the plates of the capacitor (the electrode surfaces 26 and 28, the electrode surface 26 and body 27 or a combination thereof). The inherent electric field of a target redistributes free electrons between the plates of the capacitor and causes current to flow between the plates. The current can be detected and the target can be "identified" based on predetermined data.

Figure 6:
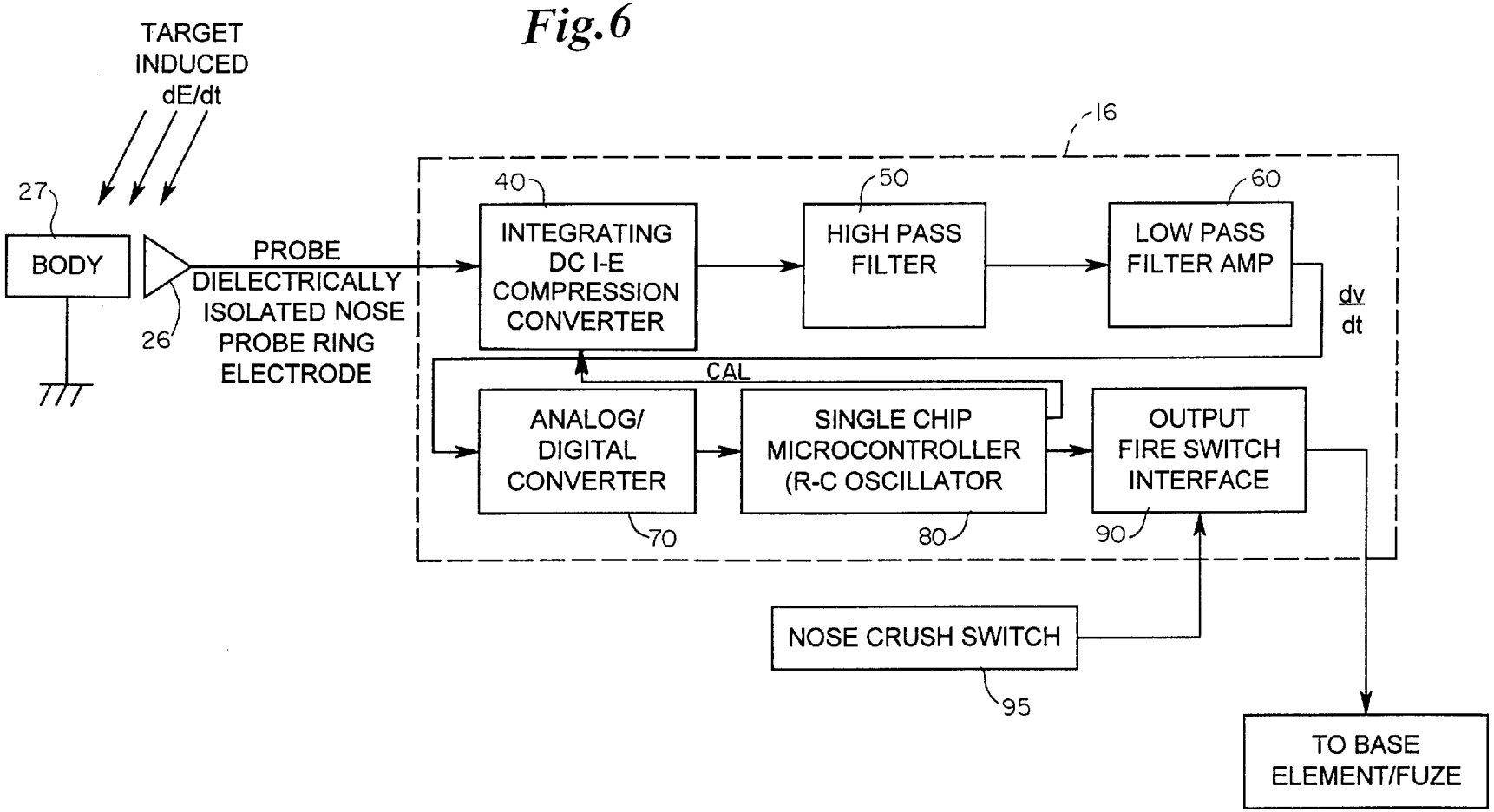
FIG. 6 illustrates a block diagram of the time changing electric field and the electronics of the invention.

Referring now to FIGS. 5 and 6, a block diagram of the sensor 35 and block diagram of the system and electronics 16 is shown. In operation, electrostatically charged airborne targets induce charge migration (current) within the charge collecting electrode 26 and current-to-voltage (I-E) converter direct coupled (DC) circuit 40 relative to the body 27 (as the second conductor) as the projectile 10 approaches the target. The probes ring electrode 26 is essentially one plate of a sensor capacitor while the projectile body 27 (and optional forward probe electrode ring 28) is/are the other plate of the sensor capacitor. The body 27 (and optional conductive area 28) is/are connected to (circuit) ground. In the preferred embodiment, the electrode ring 26 is connected to the inverting (virtual ground) input of the I-E converter 40 to form a "shorted" sensor capacitor configuration. No voltage is developed between the plates, current is read. Hence, the time changing electric field (dE/dt) enveloping the charged target-projectile time changing geometry (probe is moving) causes a time changing output current (dI/dt) to flow within the sensor probe 12 and I-E converter feedback loop 40, thus converting it to a time changing voltage (dV/dt) which is processed by subsequent analog filtering, gain and signature processing algorithm residing in the microcontroller. The circuit 40 is a suitable preamplifier which can perform the necessary tasks. The "shorted probe" I-E converter configuration is known in the art and is the preferred embodiment in sensors of this type.

Figure 7:
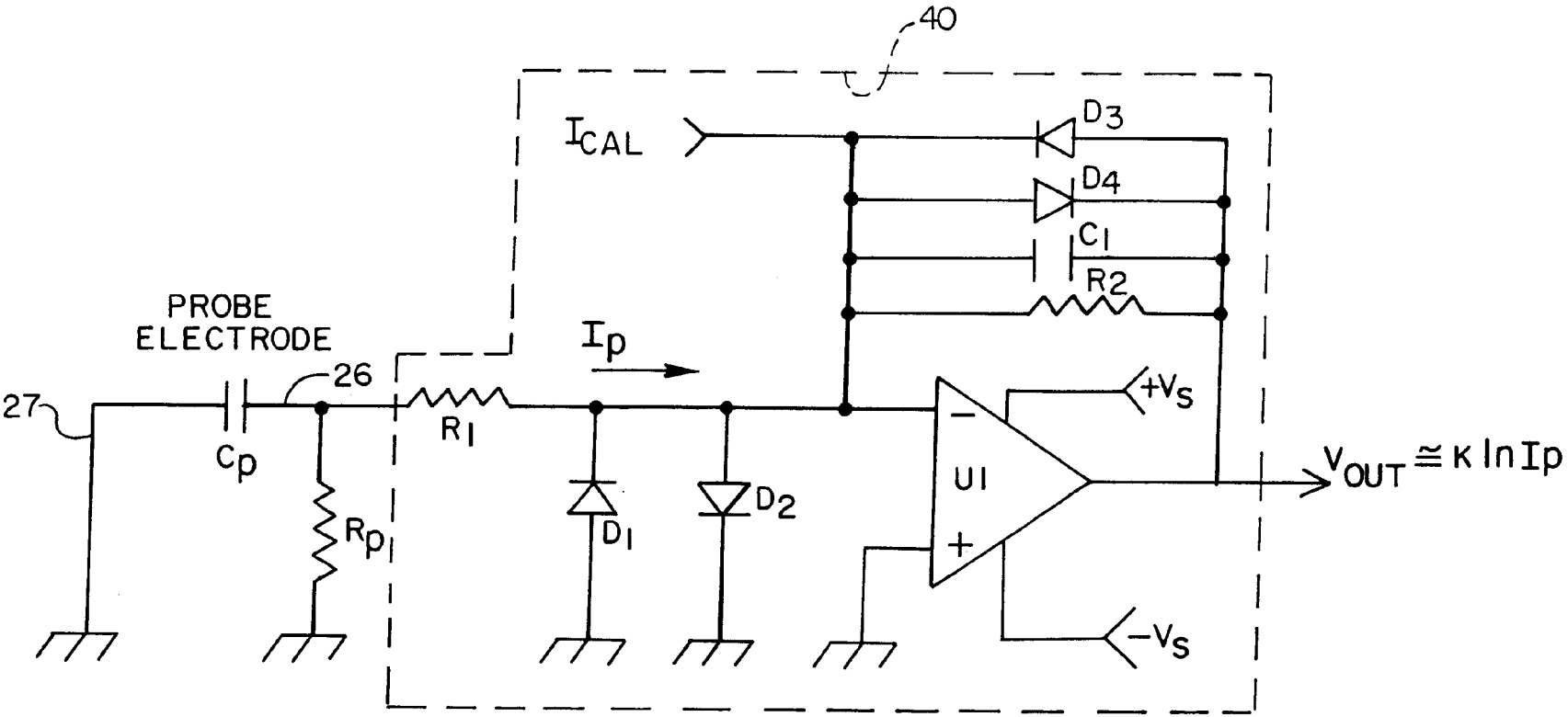
FIG. 7 illustrates a circuit diagram of an integrating DC current to voltage compression converter of the invention.

The I-E compression converter 40 is shown in more detail in FIG. 7. It should be understood that any appropriate converter may be utilized and it is not necessary to use a compression converter as described below depending on the desired results and applications. The compression converter 40 is optimal for several applications. This front-end integrating current to voltage compression converter permits lower noise bandwidth at maximum target range. The magnitude of the signal changes with a change in distance to the target. Due to this relationship which will be described in further detail below, for a given target at the closest point of approach it is desirable to compress the signal. If the signal is not compressed at this point, the electronics 16 are saturated because signal variance is too great. Therefore, the compression converter 40 is utilized which allows a narrow noise bandwidth under small signature current conditions (maximum miss distance) while permitting high slew-rate (wide bandwidth) signatures associated with small proximity miss distances. The maximum miss distance is the farthest point from which the target can be detected. The smallest proximity miss distance refers to the closest point to the target when a projectile is not on a collision course.

In principle, the electrostatic probe "front-end" consists of an inverting amplifier configuration with a non-linear signal compression feedback loop to convert the wide dynamic range of input probe currents, associated with real-world target encounter scenarios, to an output voltage that remains unsaturated. The output voltage remains within the dynamic range capability of the amplifiers power supply. This configuration is relevant only for the shorted probe (current mode) configuration as shown where the probes active electrode is connected to the amplifiers inverting input or "virtual ground" which does not allow a voltage to develop across the probe electrodes but instead transforms the current through it to an output voltage. Also, the amplifier feedback loop non-linear compression elements interact with the parallel resistor-capacitor (pole) such as to effect a non-linear dominant pole whose roll-off frequency is a function of the feedback loop/probe current. This feature yields a (low noise) small bandwidth for low probe currents (long range targets) and a large bandwidth for large probe currents which results in greater amplifier slew rate capability. Greater amplifier slew rate capability is necessary for processing the bipolar signature rates-of-change associated with near miss target scenarios. Those skilled in the art will understand that this front-end circuit configuration includes "input components" which provide amplifier protection under "overload" conditions but are not considered essential operational elements of the circuit.

Referring to FIG. 7, shorted probe connection current ($I_p$) flows through amplifier (U1) feedback loop elements (R2, C1, D3/D4). The magnitude of this current is a function of the time changing electric field (dE/dt) in which the probe ($C_p$) is "immersed" and the polarity of the current is a function of time or probe-target relative position. Resistance ($R_p$) represents the probe's dielectric conductivity which is controlled to provide a "static charge" leakage path directly to ground without causing excessive attenuation (current shunting) of the lowest frequency target induced currents. Amplifier input overload protection is provided by symmetrical clamping (R1, D1/D2) designed for negligible affect on "normal" processing currents. Symmetrical clamping is provided by matching D1 and D2 so that negligible (DC) offset error is produced with any (high frequency out-of-band) interfering input currents. The target induced probe current ($I_p$) is a function of the probe sensitivity and velocity with respect to the target and instantaneous coordinates (x,y) with respect to the target given by the following equation:

$$I_p(x) = K_p\left(\frac{dE_x}{dt}\right) = K_p\left(\frac{Qv_x}{4\pi\epsilon_0}\right)\left[\frac{y^2 - 2x^2}{(x^2 + y^2)^{5/2}}\right]$$

where

Kp=probe sensitivity in amps/$V_t$/(meter-sec)

$V_t$=target voltage in volts

Q=target charge in Coulombs $\upsilon_x$=probe velocity in meters per sec $4\pi\epsilon_0=1.1\times10^{-10}$ Farads per meter y=probe—target miss distance, (rectangular coordinate offset trajectory at closest point of approach)

x=probe—target closure distance (rectangular coordinate distance between probe and target)

The instantaneous x,y coordinates/distances give rise to probe currents that effectively vary as the inverse cube of x,y which yields a wide dynamic range of $I_p$ in application i.e., a $\Delta x$ or $\Delta y$ change of 10 can translate to a $\Delta I_p$ of 1000. The non-linear (symmetrical compression) characteristics of matched diodes, D3/D4 cause an amplifier output voltage that approximately varies as the natural logarithm of the probe current which prevents amplifier output voltage saturation ($<V_s$) over a very wide dynamic range of probe current ($\Delta I_p$ of $10^6$) in practice. The probe current distribution through the parallel feedback paths $R_2$, $C_1$, D3/D4 is a function of the current magnitude. At minimum levels of $I_p$, diodes D3 or D4 conduction is negligible compared to $R_2$ such that $R_2$ alone essentially determines the output voltage, $V_{out}\cong I_pR_2$. At maximum levels of $I_p$, diode D3 or D4 conduction is dominate and the output voltage is a function of the diode characteristics i.e. natural logarithm of $I_p$ and temperature.

The diode temperature dependance can be "calibrated out" in practice by injecting (+/−) calibration currents ($I_{CAL}$) into the feedback loop prior to a the signal is to be utilized. The magnitude would be utilized for example if the application allows for collection of a great amount of data which may be used in firing algorithms in missiles. The calibration is done using a resistor and a bipolar reference voltage or a current source. This log calibration is known to those skilled in the art.

The overall frequency roll-off characteristics of the current-to-voltage compression converter 40 is a function of probe current as stated above due to the current dependent diode conductance characteristics interacting in parallel with $R_2$, $C_1$. At low levels of $I_p$, diode conductance is negligible such that high frequency roll off is determined by $R_2//C_2$ alone whose time constant is chosen to include only the "significant" target induced frequencies at maximum specified range which in turn sets the lowest possible noise bandwidth. Under maximum levels of $I_p$, however, the conductance of the diodes dominate over the value of $R_2$ such that the high frequency rolloff/cut-off is extended which in turn allows for higher slew rate capability of the overall stage for a given value of $C_1$. This insures that close-in target induced signatures/rates-of-change will be properly processed by subsequent signal processing and associated algorithms.

In the preferred embodiment, the I-E compression converter 40 is connected to high pass filter 50 and low pass filter amplifier 60 to exclude frequencies not associated with the target spectrum. Signal processing is done in time with the analog to digital converter 70 connected to the filter 50 and 60 filter/amplifier 60. Microcontroller 80 is connected to the analog to digital converter 70 and includes the appropriate algorithms and necessary peripherals including a timer. A look-up table (amplitude vs. time) algorithm is utilized in the preferred embodiment. The microprocessor 80 is connected to the output fire switch interface 90. The interface 90 receives information from the controller 80 to detonate or receives input from a nose crush switch 95 to detonate. This detonation signal is connected to the base element/fuze of the projectile 10. The nose crush switch 95 is known to those skilled in the art and is a parallel firing switch for ensuring detonation in direct contact with a target. The "shorted probe" I-E sensor configuration provides unique signatures for both projectile/target fly-by (proximity) and collision course scenarios. The fly-by or proximity scenario produces a bipolar signature characteristic and the collision course or direct contact scenario produces a signature characteristic and the collision course or direct contact scenario produces a unipolar signature characteristic. The discriminating signature characteristics allow an appropriate microcontroller algorithm 80 to determine a fly-by scenario and appropriate fire output/burst point by virtue of the bipolar signature. In a typical application, the detection algorithm looks for the time where the signal is above a predetermined threshold; the time from a second threshold crossing to zero crossing; and the time from zero crossing to a detect threshold. For a projectile collision course scenario, the signature is unipolar which results in no proximity fire output by virtue of signature recognition algorithm and resorts to the point detonating (crush or tremble switch 95) fire output mode. This recognition feature (and excellent clutter rejection) capability of the ES proximity sensor 35 eliminates the need for a manually-set air/ground switch as on past proximity switches.

An optional probe "front-end" would be a high input impedance voltage amplifier. In this embodiment, voltage, not current, would be read. The various electronics utilized with this embodiment are well known to those skilled in the art. However, this embodiment would not produce the ideal signature characteristics of the preferred embodiments described above.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A sensing apparatus for sensing an inherent electric field surrounding an electrostatically charged threat aircraft for use with a projectile, the projectile having a conductive body, the sensing apparatus comprising:

(a) a nose cone made of a dielectric material, the nose cone having an inner surface and connected to the projectile;

(b) an electrically conductive area connected to the inner surface of the nose cone and conductively separated from the projectile body; and (c) detection means for detecting a time rate of change current between the conductive area and the projectile body induced by the electric field surrounding the electrostatically charged threat aircraft, the detection means operatively connected to the conductive area and the projectile body, the connections being internal to the nose cone and the projectile body.

2. The apparatus of claim 1 wherein the nose cone dielectric material is a ceramic.

3. The apparatus of claim 1 wherein the nose cone dielectric material is a ferrite filled ceramic.

4. The apparatus of claim 1 wherein the nose cone dielectric material is a semiconducting material.

5. The apparatus of claim 1 further comprising signal compression processing means for converting the time rate of change current signal from the detection means to a time rate of change voltage signal with a gain and a bandwidth which are a function of the detected current, the compression means conductively connected to the detection means.

6. The apparatus of claim 1 further comprising calibration means for calibrating the detected current, the calibration means conductively connected to the detection means.

7. The apparatus of claim 1 further comprising fuze means conductively connected to the detection means for detonating the projectile.

8. The apparatus of claim 1 further comprising a second conductive area separated from the conductive area and connected to the inner surface of the nose cone, the second conductive area electrically connected to the body of the projectile.

9. The apparatus of claim 1 wherein the nose cone is silicon nitride.

10. The apparatus of claim 1 wherein the nose cone is silicon carbide.

11. The apparatus of claim 1 further comprising: a second conductive area separated from the conductive area and the projectile body; a third conductive area separated from the conductive area, second conductive area and the projectile body; and second detection means for detecting a time rate of change current between the second and third conductive areas, the detection means operatively connected to the second conductive area and the third conductive area.

12. An apparatus for use with a projectile, comprising:

(a) a nose cone made of a dielectric material, the nose cone having an inner surface and connected to the projectile;

(b) a first electrically conductive area connected to the inner surface of the nose cone;

(c) a second electrically conductive area conductively separated from the first conductive area and connected to the inner surface of the nose cone; and (d) detection means connected to the first and second conductive areas for detecting a time rate of change current between the first and second conductive areas induced by an electric field surrounding an electrostatically charged threat aircraft, the connections being internal to the nose cone.

13. An apparatus for sensing an electric field surrounding an electrostatically charged threat aircraft for use with a projectile, comprising:

(a) a nose cone made of a dielectric material, the nose cone having an inner surface and connected to the projectile;

(b) a first electrically conductive area connected to the inner surface of the nose cone;

(c) a second electrically conductive area connected to the inner surface of the nose cone and insulated from the first electrically conductive area; and (d) detection means connected to the first and second conductive areas for detecting a time rate of change voltage between the first conductive area and the second conductive area induced by the electric field surrounding the electrostatically charged threat aircraft, the connections being internal to the nose cone.

14. An apparatus for sensing an electric field surrounding an electrostatically charged threat aircraft for use with a projectile, the projectile having a conductive body, comprising:

(a) a nose cone made of a dielectric material, the nose cone having an inner surface and connected to the projectile;

(b) an electrically conductive area connected to the inner surface of the nose cone and separated from the projectile body; and (c) detection means connected to the conductive area and the projectile body for detecting a time rate of change voltage between the electrically conductive area and the projectile body induced by the electric field surrounding the electrostatically charged threat aircraft, the connections being internal to the nose cone and the projectile body.

15. The apparatus of claim 14 further comprising a second electrically conductive area separated from the electrically conductive area and connected to the inner surface of the nose cone, the second conductive area electrically connected to the body of the projectile.

16. A proximity sensor for a projectile, comprising:

(a) a nose cone made of ceramic having an inner surface; and (b) sensing means connected to the inner surface of the nose cone for sensing threat aircraft, the connection being internal to the nose cone.

17. The sensor of claim 16 wherein the sensing means further comprises:

(a) a first electrically conductive area connected to the inner surface of the nose cone;

(b) a second electrically conductive area connected to the inner surface of the nose cone;

(c) insulating means for separating the first conductive area from the second conductive area; and (d) detection means operatively connected to the first and second areas for detecting a time changing electric field between the first and second conductive areas due to threat aircraft, the connections being internal to the nose cone.

18. The sensor of claim 17 wherein the insulating means is a dielectric material.

19. The sensor of claim 17 wherein the insulating means is an area of the nose cone.

20. The apparatus of claim 16 further comprising fuze means conductively connected to the detection means for detonating the projectile.

21. The sensor of claim 16 wherein the sensing means further comprises:

(a) an electrically conductive area connected to the inner surface of the nose cone;

(b) an electrically conductive projectile body;

(c) insulating means for separating the conductive area from the projectile body; and (d) detection means operatively connected to the conductive area and the projectile body for detecting a time changing electric field between the conductive area and the projectile body due to threat aircraft, the connections being internal to the nose cone and the projectile body.

* * * * *